US005380191A

United States Patent [19]

Itakura et al.

[11] Patent Number: 5,380,191

[45] Date of Patent: Jan. 10, 1995

[54] PULSE COMBUSTOR

[75] Inventors: Tadashi Itakura, Ebetu; Susumu Ejiri, Toyoake, both of Japan

[73] Assignee: Paloma Kogyo Kabushiki Kaisha, Nagoya, Japan

[21] Appl. No.: 121,771

[22] Filed: Sep. 15, 1993

[30] Foreign Application Priority Data

Sep. 18, 1992 [JP] Japan ..... 4-275332

[51] Int. Cl.[6] ..... F23C 11/04

[52] U.S. Cl. ..... 431/1; 126/360 R

[58] Field of Search ..... 431/1; 126/360 R, 350 R

[56] References Cited

U.S. PATENT DOCUMENTS 4,919,085 4/1990 Ishiguro .
4,934,923 6/1990 Yokyama et al. .
4,976,604 12/1990 Nishino .
5,201,649 4/1993 Aoki et al. .
5,205,727 4/1993 Aoki et al. .

FOREIGN PATENT DOCUMENTS 61-89413 10/1984 Japan .
207812 10/1985 Japan ..... 431/1

*Primary Examiner*—Carroll B. Dority
*Attorney, Agent, or Firm*—W. Hugo Liepmann

[57] ABSTRACT

The invention provides an improved valve-less pulse combustor including a plurality of combustion systems and one common air supply system, wherein the air supply system includes an air supply controller which interferes with air supply to a combustion system under non-combustion conditions so as to effectively prevent a cooking medium in a tank of the combustion system from being cooled by the air supplied. The air supply controller may be a solenoid valve or a damper using a solenoid or a motor as a driving source.

10 Claims, 3 Drawing Sheets

PULSE COMBUSTOR

BACKGROUND OF THE INVENTION

1. Field of the Invention

The present invention relates to an improved valve-less pulse combustor used as a heat source of commercial hot water supply systems and a variety of cooking apparatus including fryer apparatus.

2. Description of the Related Art

A pulse combustor generally includes an air supply system having an air supply blower and an admission muffler and a combustion system having a burner, a combustion chamber, a tail pipe, and an exhaust muffler. The combustion chamber and the tail pipe of the combustion system are typically disposed in a water tank or an oil tank (hereinafter both referred to as tank), so that the pulse combustor functions as a heat source of hot water supply systems and a variety of cooking apparatus such as fryer apparatus. When a variety of food items are cooked in one cooking apparatus, a plurality of tanks and a corresponding number of combustion systems are required in one cooking apparatus.

Since a corresponding number of air supply systems can not be installed in one cooking apparatus because of the limited space, one air supply system is commonly used for the plurality of combustion systems in general. In such a pulse combustor, a fixed amount of air is fed from the common air supply system to all the combustion systems.

In a conventional pulse combustor with a valve, an air supply blower is activated only for ignition. In a valve-less pulse combustor having a plurality of combustion systems and one common air supply system, however, an air supply blower works to supply a fixed amount of air during combustion as well as at an ignition timing. This causes the air to be undesirably supplied to a combustion system under non-combustion conditions so as to cool a cooking medium in a water tank or an oil tank of the combustion chamber, thus lowering the heating efficiency.

SUMMARY OF THE INVENTION

One object of the invention is to provide an improved valve-less pulse combustor including a plurality of combustion systems and one common air supply system.

Another object of the invention is to prevent a cooking medium in a tank of a combustion system under non-combustion conditions from being cooled by the air supplied to the combustion system.

Still another object of the invention is to provide an economical valve-less pulse combustor with high heating efficiency.

The above and other related objects are realized by a pulse combustor of the invention including a plurality of combustion systems each having a burner, a combustion chamber, a tail pipe, an exhaust muffler, and an exhaust conduit, and one common air supply system having an air supply blower, a pair of air supply conduits, and a pair of air chambers, wherein the air supply system includes an air supply controller for supplying a fixed amount of air to at least one combustion system under combustion conditions and interfering with air supply to the rest of the plurality of combustion systems under non-combustion conditions.

The combustion chamber and the tail pipe of each combustion system is generally disposed in a tank (a water tank or an oil tank) of a cooking apparatus to heat a cooking medium, for example, water or cooking oil, in the tank.

When at least one of the plurality of combustion systems is under combustion conditions, the air supply blower goes on to supply a fixed amount of air. The air supply controller supplies the air to the combustion systems under combustion conditions for continuous and secure combustion of the burner while interfering the air supply to the rest of the plurality of combustion systems under non-combustion conditions. This effectively prevents the temperature of a cooking medium in the tank of the combustion system under non-combustion conditions from being undesirably lowered, thus improving the heating efficiency of pulse combustion.

These and other objects, features, aspects, and advantages of the present invention will become more apparent from the following detailed description of the preferred embodiment with the accompanying drawings.

DESCRIPTION OF THE PREFERRED EMBODIMENT

Figure 1:
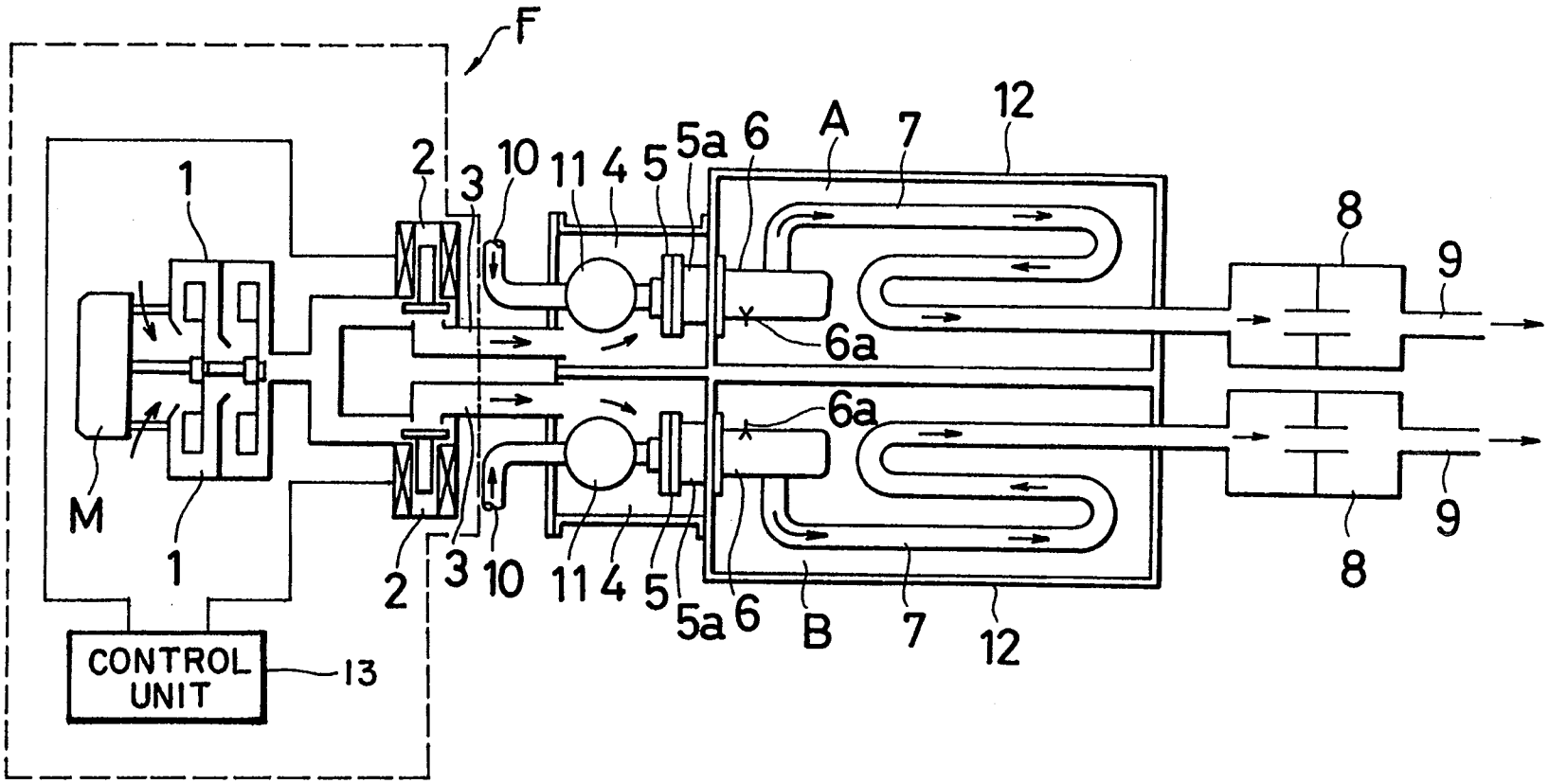
FIG. 1 is a schematic view illustrating a pulse combustor embodying the invention.
Figure 2A:
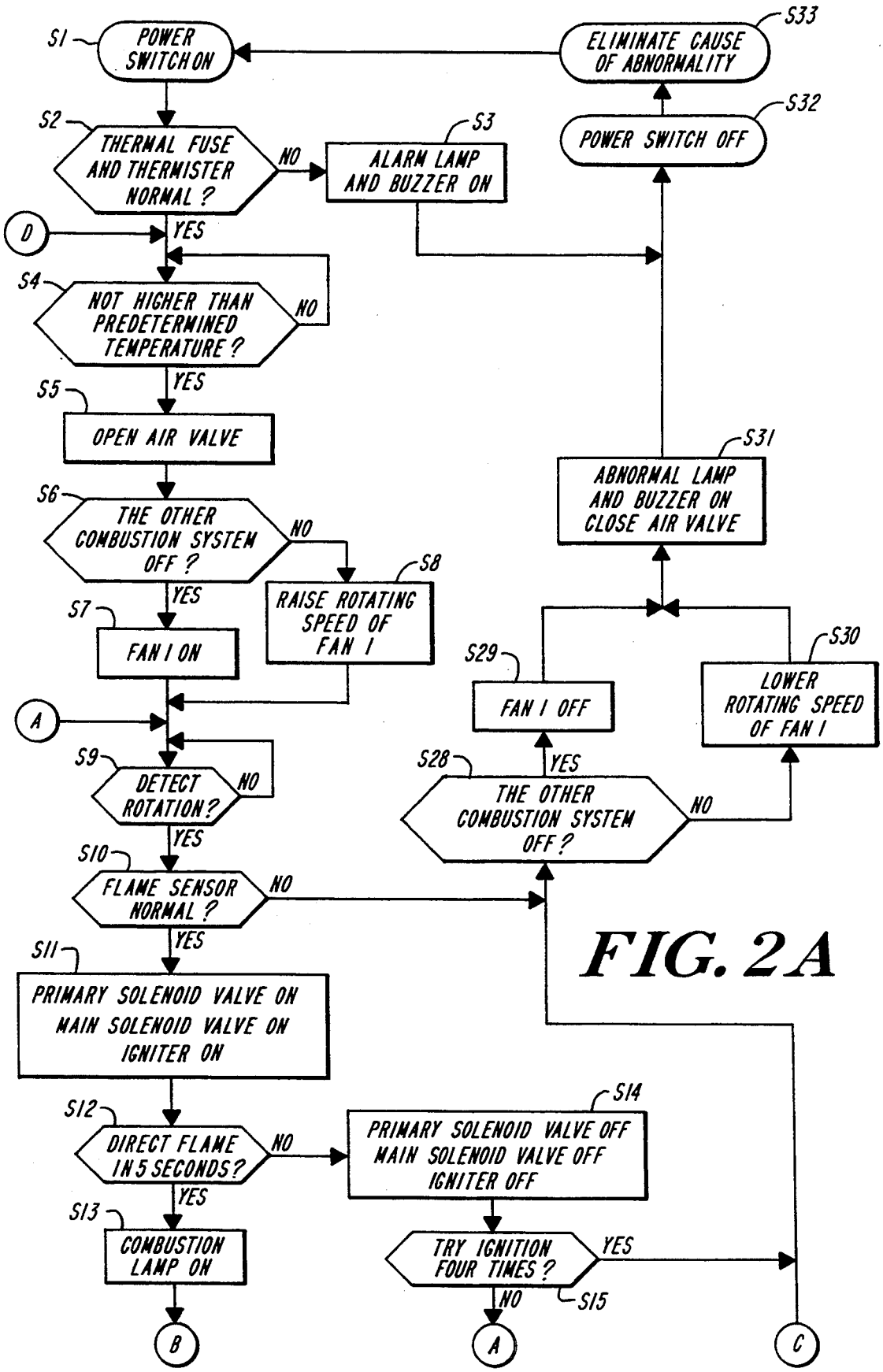
FIGS. 2A and 2B are flowcharts showing operation of the pulse combustor.
Figure 2B:
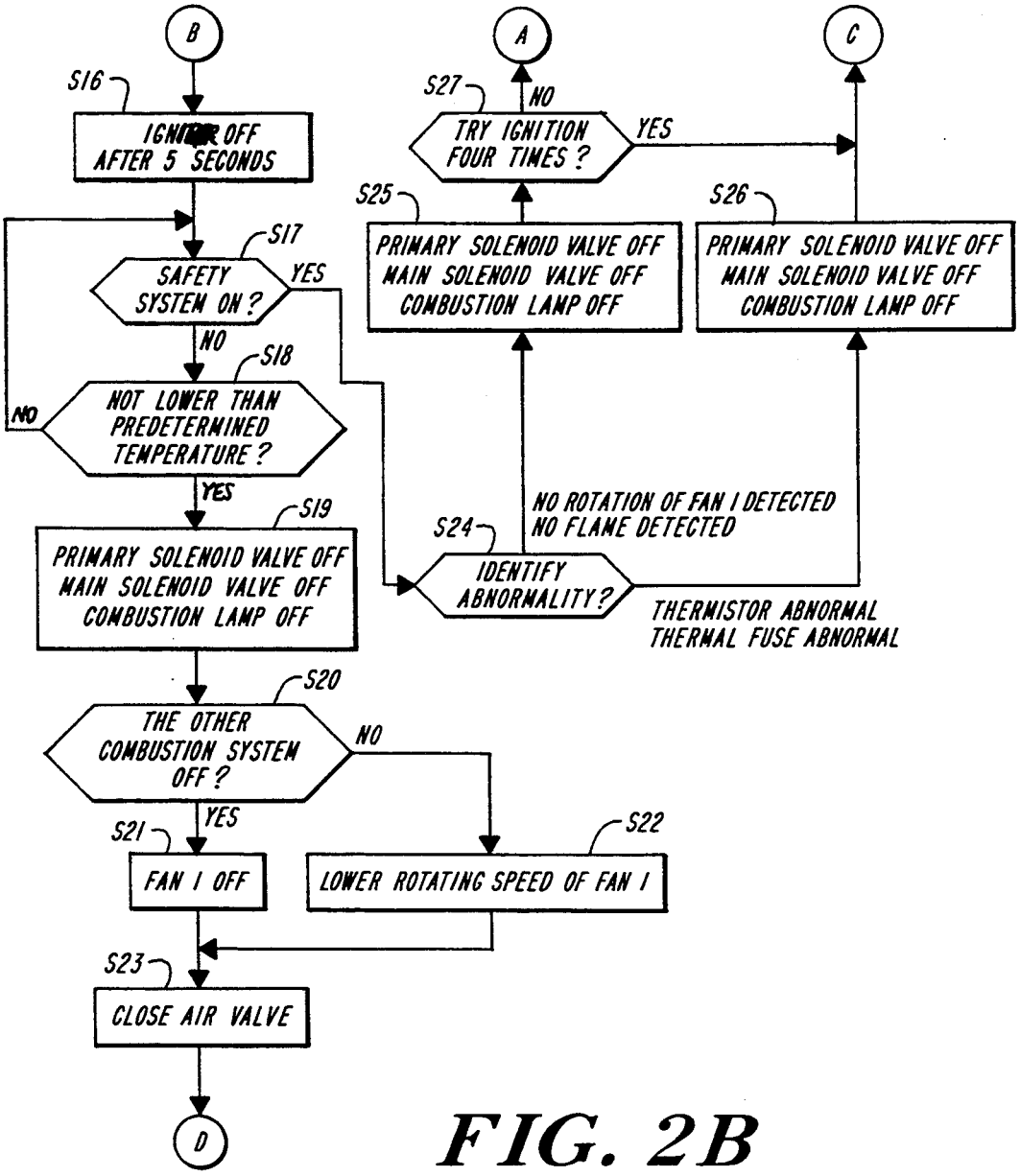

A pulse combustor embodying the invention is described in detail according to the schematic view of FIG. 1 and the flowcharts of FIGS. 2A and 2B.

The pulse combustor of the embodiment includes two combustion systems A and B arranged in parallel and one air supply system F commonly used for forcible air supply to at least one of the combustion systems A and B at the time of ignition and during combustion.

As shown in FIG. 1, the air supply system F includes a control motor M, a fan 1 functioning as an air supply blower, an admission muffler (not shown), a pair of solenoid valves 2 functioning as an air supply controller (hereinafter referred to as air valve) and connected with a control unit 13, a pair of air supply conduits 3, and a pair of air chambers 4. The air supply system F is activated to supply a fixed amount of air to at least one of the combustion systems A and B at the time of ignition and during combustion. When the air supply system F is activated, the fan 1 starts rotation to supply air to the air chambers 4 via the admission muffler, the air valves 2, and the air supply conduits 3. A fixed amount of the air is then forcibly supplied from the air chamber 4 to a mixing chamber 5*a* of a burner unit 5 in each of the combustion systems A and B.

Each combustion system A or B includes the burner unit 5, a combustion chamber 6, a tail pipe 7, an exhaust muffler 8, and an exhaust conduit 9. A fuel gas supplied through a gas conduit 10 to a gas chamber 11 is automatically supplied in a fixed amount to the mixing chamber 5*a* of the burner unit 5 in each combustion system A or B at every pulse cycle. The fuel gas is sufficiently mixed with the air supplied from the air supply system F, and fed to the combustion chamber 6 as an air/fuel mixture. An ignition plug or igniter 6*a* is then activated to start combustion of the air/fuel mixture in the combustion chamber 6. After the ignition plug 6*a* is inactivated, self-ignition and combustion continues in the combustion chamber 6. Each combustion system A or B further includes a flame sensor (not shown) for detecting an ignition flame or a combustion flame.

The combustion chambers 6 and the tail pipes 7 of the combustion systems A and B are respectively disposed in tanks 12,12 of a cooking apparatus (not shown) and function as a heat source to heat a cooking medium such as water or oil in the tanks 12,12.

When one of the combustion systems A and B, for example, the combustion system A, is under combustion conditions and the other of the combustion systems A and B, for example, the combustion system B, is under non-combustion conditions, the air valve 2 in the air supply system F, supplies the air fed from the fan 1 to the combustion system A and interferes with air supply to the combustion system B.

A typical operation of the pulse combustor thus constructed is described according to the flowcharts of FIGS. 2A and 2B. In the description below, each element shown by a numeral+the character 'A' or 'B' denotes that the element belongs to the combustion system A or B; for example, the combustion chamber 6A represents the combustion chamber 6 for the combustion system A.

When a power switch of a combustion system, for example, the combustion system A, is turned ON at step S1, the program goes to a decision point S2 at which it is determined whether both a thermal fuse (not shown) and a thermistor (not shown) are normal, where the thermistor having a resistance not less than 4MΩ is determined to be abnormal. When either the thermal fuse or the thermistor is abnormal, the program goes to step S3 at which an alarm lamp and an alarm buzzer (not shown) inform a user of abnormality. When both the thermal fuse and the thermistor are normal, the program goes to step S4 at which it is determined whether the temperature of a cooking medium in either of the tanks 12,12 (the tank 12A in this embodiment) is less than a predetermined value.

When the answer is YES at step S4, the program proceeds to step S5 at which the air valve 2A of the combustion system A is opened. The program then goes to step S6 at which it is determined when the other combustion system B is under non-combustion conditions. When the answer is YES at step S6, the program goes to step S7 at which the fan 1 is activated to start rotation. When the answer is NO at step S6, on the other hand, the program goes to step S8 at which the rotating speed of the fan 1 is raised.

After execution of step S7 or S8, the program goes to step S9 at which it is determined whether rotation of the fan 1 is detected. When rotation of the fan 1 is detected at step S9, the program proceeds to step S10 at which it is determined whether the flame sensor is normal. When the flame sensor is normal, the program goes to step S11 at which a primary gas solenoid valve (not shown), a main gas solenoid valve (not shown), and the ignition plug 6a are turned ON. When a flame is detected (when the flame current is not less than 0.1 μA) within five seconds after activation of the ignition plug 6a at step S12, the program goes to step S13 at which a combustion lamp (not shown) goes on.

When no flame is detected within five seconds at step S13, on the other hand, the program goes to step S14 at which the primary gas solenoid valve, the main gas solenoid valve, and the ignition plug 6a are all turned off. After execution of step S14, it is determined whether ignition has been tried four times at step S15.

After execution of step S13, the program goes to step S16 at which the ignition plug 6a is turned off five seconds after detection of the flame. When a safety system (not shown) of the pulse combustor is activated at step S17, the program goes to step S24 to find a cause of the activation. When the safety system is activated due to detection of no rotation of the fan 1 or no flame, the program goes to step S25 to turn off the primary gas solenoid valve and the main gas solenoid valve. After the combustion lamp goes out, the program goes to step S27 at which it is determined whether ignition has been tried four times. When the cause of activation of the safety system is determined to be abnormality in either the thermistor or the thermal fuse at step S24, on the other hand, the program goes to step S26 to turn off the primary gas solenoid valve and the main gas solenoid valve, when the combustion lamp goes out.

When the safety system is not activated at step S17, the program goes to step S18 at which it is determined whether the temperature of the cooking medium in the tank 12A is not less than the predetermined value. When the temperature of the cooking medium is less than the predetermined value, the program returns to step S17 to determine whether the safety system is ON. When the answer is YES at step S18, the program goes to step S19 to turn off the primary gas solenoid valve and the main gas solenoid valve, when the combustion lamp goes out.

At step S20 it is determined whether the other combustion system B is under non-combustion conditions. When the answer is YES, the program goes to step S21 to turn the fan 1 off. When the combustion system B is under combustion conditions, on the other hand, the program goes to step S22 at which the rotating speed of the fan 1 is lowered. After execution of either step S21 or step S22, the air valve 2A is closed at step S23. The program then returns to step S4 to wait until the temperature in the tank 12A becomes less than the predetermined value.

When ignition has not been tried four times at step S15 or S27, the program returns to step S9 to detect rotation of the fan 1.

When ignition has been tried four times at step S15 or S27 or when the flame sensor is determined to be abnormal at step S10, the program goes to step S28 at which it is determined whether the other combustion system B is under non-combustion conditions. When the answer is YES at step S28, the program goes to step S29 at which the fan 1 is turned off when the combustion system B is under combustion conditions, on the other hand, the program goes to step S30 at which the rotating speed of the fan 1 is lowered. After execution of step S29 or S30, the program goes to step S31 at which the abnormal lamp and the abnormal buzzer are activated and the air valve 2A is closed.

After execution of step S31 or step S3, the program goes to step S32 at which the power switch of the pulse combustor is turned off. After the cause of abnormality is eliminated at step S33, the power switch is turned ON again.

When the air valve 2A of the combustion system A is open while the other combustion system B is under non-combustion conditions, the fan 1 is turned ON. The air valve 2B of tile combustion system B is closed to interfere with air supply from the fan 1 to the combustion system B under such circumstances. This prevents the temperature of the cooking medium in the tank 12B from being lowered by the air, thus improving the heating efficiency of pulse combustion.

The solenoid valves 2,2 used as an air supply controller may be replaced by a pair of dampers each using a solenoid or a motor as a driving source. The air supply controller may have a structure for performing a supplementary function, that is, controlling a combustion amount of the burner unit 5 in each combustion system A or B as well as an essential function for switching ON and OFF the air supply.

There may be many other changes, modifications, and alterations without departing from the scope or spirit of essential characteristics of the invention, and it is thereby clearly understood that the above embodiment is only illustrative and not restrictive in any sense. The spirit and scope of the present invention is only limited by the terms of the appended claims.

What is claimed is:

1. A pulse combustor comprising a plurality of combustion systems each having a burner, a combustion chamber, a tail pipe, an exhaust muffler, and an exhaust conduit, and one common air supply system having an air supply blower, a plurality of air supply conduits, and a plurality of air chambers, wherein said air supply system includes air supply control means for supplying a fixed amount of air to at least one combustion system under combustion conditions and interfering with air supply to the rest of said plurality of combustion systems under non-combustion conditions.

2. A pulse combustor in accordance with claim 1, wherein said air supply control means comprises a plurality of solenoid valves each corresponding to said plurality of combustion systems, at least one of said plurality of solenoid valves corresponding to said rest of said plurality of combustion systems under non-combustion conditions being closed to interfere with air supply to said combustion systems under non-combustion conditions.

3. A pulse combustor in accordance with claim 1, wherein said air supply control means comprises a plurality of solenoid dampers each corresponding to said plurality of combustion systems, at least one of said plurality of solenoid dampers corresponding to said rest of said plurality of combustion systems under non-combustion conditions being activated to interfere with air supply to said combustion systems under non-combustion conditions.

4. A pulse combustor in accordance with claim 1, wherein said air supply control means comprises a plurality of motor dampers each corresponding to said plurality of combustion systems, at least one of said plurality of motor dampers corresponding to said rest of said plurality of combustion systems under non-combustion conditions being activated to interfere with air supply to said combustion systems under non-combustion conditions.

5. A hot water supply system for supplying and reserving hot water comprising a plurality of water tanks and a pulse combustor for heating water in said water tanks, said pulse combustor comprising a plurality of combustion systems each having a burner, a combustion chamber, a tail pipe, an exhaust muffler, and an exhaust conduit, and one common air supply system having an air supply blower, a plurality of air supply conduits, and a plurality of air chambers, said combustion chamber and said tail pipe of each combustion system being disposed in each water tank, wherein said air supply system includes air supply control means for supplying a fixed amount of air to at least one combustion system under combustion conditions and interfering with air supply to the rest of said plurality of combustion systems under non-combustion conditions.

6. A hot water supply system in accordance with claim 5, wherein said air supply control means comprises a plurality of solenoid valves each corresponding to said plurality of combustion systems, at least one of said plurality of solenoid valves corresponding to said rest of said plurality of combustion systems under non-combustion conditions being closed to interfere with air supply to said combustion systems under non-combustion conditions.

7. A cooking apparatus for cooking a variety of food items comprising a plurality of tanks and a pulse combustor for heating a cooking medium in said tanks, said pulse combustor comprising a plurality of combustion systems each having a burner, a combustion chamber, a tail pipe, an exhaust muffler, and an exhaust conduit, and one common air supply system having an air supply blower, a plurality of air supply conduits, and a plurality of air chambers, said combustion chamber and said tail pipe of each combustion system being disposed in each tank, wherein said air supply system includes air supply control means for supplying a fixed amount of air to at least one combustion system under combustion conditions and interfering with air supply to the rest of said plurality of combustion systems under non-combustion conditions.

8. A cooking apparatus in accordance with claim 7, wherein said air supply control means comprises a plurality of solenoid valves each corresponding to said plurality of combustion systems, at least one of said plurality of solenoid valves corresponding to said rest of said plurality of combustion systems under non-combustion conditions being closed to interfere with air supply to said combustion systems under non-combustion conditions.

9. A pulse combustor comprising a plurality of combustion systems each having a burner, a combustion chamber, a tail pipe, an exhaust muffler, and an exhaust conduit, and one common air supply system having an air supply blower, a plurality of air supply conduits, a plurality of air chambers, and air supply control means, said air supply control means further including a plurality of controllable valves corresponding to said plurality of combustion systems, wherein said air supply control means coordinates the operation of said controllable valves and said air supply blower to provide air to one or more combustion systems undergoing combustion and to prevent air supply to said combustion systems not undergoing combustion.

10. The pulse combustor according to claim 9 wherein said air supply control means includes means for controlling said air supply blower and said controllable valves to provide air to said combustion systems undergoing combustion both during ignition and during subsequent combustion of said combustion systems.

* * * * *